US006465411B2

(12) United States Patent
Manske et al.

(10) Patent No.: US 6,465,411 B2
(45) Date of Patent: Oct. 15, 2002

(54) PINE OIL CLEANING COMPOSITION

(75) Inventors: Scott D. Manske, Davidson; Martha Shea McPherson, Weddington, both of NC (US)

(73) Assignee: Clariant International Ltd., Muttenz (CH)

( * ) Notice: Subject to any disclaimer, the term of this patent is extended or adjusted under 35 U.S.C. 154(b) by 89 days.

(21) Appl. No.: 09/742,821

(22) Filed: Dec. 21, 2000

(65) Prior Publication Data

US 2002/0123451 A1 Sep. 5, 2002

(51) Int. Cl.[7] ..... C11D 1/86; C11D 3/44

(52) U.S. Cl. ..... 510/417; 510/238; 510/357; 510/365; 510/405; 510/433; 510/435; 510/504; 510/505; 510/506

(58) Field of Search ..... 510/238, 365, 510/357, 405, 435, 433, 504, 505, 506, 417

(56) References Cited

U.S. PATENT DOCUMENTS

| | | | | |
|---|---|---|---|---|
| 4,414,128 | A | | 11/1983 | Goffinet |
| 4,597,887 | A | * | 7/1986 | Colodney et al. |
| 5,591,708 | A | | 1/1997 | Richter |
| 5,728,672 | A | | 3/1998 | Richter |
| 5,962,394 | A | | 10/1999 | Gryj et al. |
| 5,985,819 | A | | 11/1999 | Lu et al. |
| 6,066,606 | A | | 5/2000 | Lu et al. |

* cited by examiner

*Primary Examiner*—Gregory E. Webb

(74) *Attorney, Agent, or Firm*—Scott E. Hanf; Krishna Banerjee

(57) ABSTRACT

Disclosed is a liquid pine oil cleaning composition containing: A) water; B) about 5–20% by weight of pine oil; C) about 2–10% by weight of an organic solubilizer distinct from said pine oil; D) about 0.1–5% by weight of an alkalinity agent; E) about 0.1–15% by weight of an anionic surfactant; F) about 0.01 to about 2% by weight by weight of a cationic surfactant comprising a quaternary ammonium salt represented by the formula

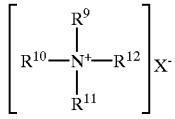

wherein $R^9$ and $R^{10}$ are independently a hydrogen or a $C_{1-3}$ alkyl group; $R^{11}$ is a $C_8$-$C_{18}$ alkyl group; and $R^{12}$ is a $C_{1-3}$ alkyl group or an ethoxylate group represented by the formula $—(CH_2CH_2O)_yH$, wherein y is a number from 1 to 3; and $X^-$ is a halide ion or a methosulfate, and G) about 0.1 to 10% by weight of a nonionic surfactant comprising an alcohol alkoxylate. Also disclosed is a method for cleaning a hard surface comprising contacting the hard surface in need of cleaning with the aforementioned pine oil cleaning composition.

17 Claims, No Drawings

PINE OIL CLEANING COMPOSITION

FIELD OF THE INVENTION

The present invention provides a blooming pine oil cleaning composition. The present invention also provides a method of cleaning a surface using the disclosed pine oil cleaning composition.

BACKGROUND OF THE INVENTION

Water-soluble cleaning compositions are commercially important products and enjoy a wide field of utility in assisting in the removal of dirt and grime from surfaces; especially those characterized as useful with "hard surfaces". One particular category of aqueous cleaning compositions are those which provide a "blooming" effect upon being added to water. Such an effect may be described as the change of the water's appearance from essentially colorless and transparent to that of a milky white or milky yellowish white, cloudy appearance upon the addition of an amount of the cleaning composition. This effect is also sometimes referred to as the "break". Such blooming is highly desirable in such pine oil type water-soluble cleaning compositions as consumer/end user associates cleaning effectiveness with the extent and degree of this blooming upon formation of a cleaning composition. Such an effect is particularly known and generally associated with pine oil type water-soluble cleaning compositions which typically include one or more of the following identifying characteristics: containing an amount of one or more resins or oils derived from coniferous species of trees; containing natural fragrances or synthetic fragrance compositions which are intended to mimic the scent of one or more resins or oils derived from coniferous species of trees; a color ranging from colorless to a deep amber, deep amber yellow or deep amber reddish color; generation of a milky or cloudy appearance when diluted with water in dilutions useful for cleaning applications. Such pine oil type cleaning compositions are generally provided in a concentrated composition which is subsequently diluted with water by an end user/consumer to form a cleaning solution therefrom.

Another important characteristic of pine oil cleaning compositions is phase stability. The composition should be clear and phase stable at temperatures of normal use and storage, before being further diluted with water. There is thus a need for a water-soluble pine oil cleaning composition that possesses the characteristics of phase stability, blooming, and efficient cleaning properties. The present invention provides such a cleaning composition. The present cleaning composition further has the attribute of providing synergistic detergency/cleaning effects resulting from the combined use of the cationic, anionic and nonionic surfactants present in the claimed cleaning compositions.

U.S. Pat. No. 4,414,128 discloses an aqueous liquid detergent composition comprising: (a) from 1% % to 20% of surfactant selected from synthetic anionic, nonionic, amphoteric and zwitterionic surfactants and mixtures thereof; (b) from 0.5% to 10% of terpene selected from mono- and sesquiterpenes and mixtures thereof, the weight ratio of surfactant:terpene lying in the range from 5:1 to 1:3 and (c) from 0.5 to 10% of a polar solvent having a solubility in water at 25° C. in the range from 0.2% to 10%, said polar solvent being selected from the group consisting of benzyl alcohol, polyethoxylated phenols containing from 2 to 6 ethoxy groups, phenylethyl alcohol, mono $C_6$–$C_9$ alkyl ethers of ethylene glycol, di-$C_4$–$C_9$ alkyl ethers of ethylene glycol, and mixtures thereof.

U.S. Pat. Nos. 5,591,708 and 5,728,672 disclose a liquid pine oil hard surface cleaning composition comprising a germicidally effective amount of a quaternary ammonium compound according to the formula $[N^{+=l}\ R_1R_2R_3R_4])X^-$ wherein at least one of $R_1$, $R_2$, $R_3$ and $R_4$ is selected from hydrophobic, aliphatic, aryl aliphatic or aliphatic aryl radical of from 6 to 26 carbon atoms, and any remaining are hydrocarbons of from 1 to 12 carbon atoms, wherein any of $R_1$, $R_2$, $R_3$ and $R_4$ may be linear or branched and may include one or more ester or amide linkages; and, X is a salt-forming anionic radical.

SUMMARY OF THE INVENTION

The present invention provides a liquid pine oil cleaning composition comprising:

A) water;

B) about 5–20% by weight of pine oil;

C) about 2–10% by weight of an organic solubilizer distinct from said pine oil;

D) about 0.1–5% by weight of an alkalinity agent;

E) about 0.1–15% by weight of an anionic surfactant;

F) about 0.01 to about 2% by weight by weight of a cationic surfactant comprising a quaternary ammonium salt represented by the formula

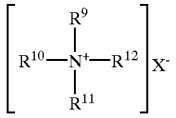

wherein $R^9$ and $R^{10}$ are independently a hydrogen or a $C_{1-3}$ alkyl group; $R^{11}$ is a $C_8$-$C_{18}$ alkyl group; and $R^{12}$ is a $C_{1-3}$ alkyl group or an ethoxylate group represented by the formula $—CH_2CH_2O)_yH$, wherein y is a number from 1 to 3; and $X^-$ is a halide ion or a methosulfate ion, and G) about 0.1 to 10% by weight of a nonionic surfactant comprising an alcohol alkoxylate.

The present invention also provides a method for cleaning a hard surface comprising contacting the hard surface in need of cleaning with the aforementioned pine oil cleaning composition.

DETAILED DESCRIPTION OF THE INVENTION

In addition to A) water, the liquid pine oil cleaning composition of the present invention comprises B) 5 to 20% (of total composition weight), and in one embodiment 5–10%, in one embodiment 10–15%, and in one embodiment 15–20% by weight of pine oil.

Pine oil is an organic solvent, and is a complex blend of oils, alcohols, acids, esters, aldehydes and other organic compounds. These include terpenes which include a large number of related terpene alcohols and terpene ketones. The terpenes include mono- and sesquiterpenes or mixtures thereof.

Preferred terpenes are mono- and bicyclic monoterpenes, especially those of the hydrocarbon class, which can be selected from terpinenes, terpinolenes, limonenes and pinenes. Highly preferred materials of this type include d-limonene, dipentene, α-pinene, β-pinene and the mixture of terpene hydrocarbons obtained from the essence of oranges (e.g., cold-pressed orange terpenes and orange terpene oil phase ex fruit juice).

An important terpene alcohol is terpineol, which is one of three isomeric alcohols having the basic molecular formula $C_{10}H_{17}OH$. One type of pine oil, synthetic pine oil, will generally have a specific gravity at 15.5° C. of about 0.9300, which is lower than the two other grades of pine oil, namely steam distilled and sulfate pine oils, and will generally contain a higher content of turpentine alcohols. Other important compounds include abietic acid (rosin), and other isoprene derivatives.

Particularly effective pine oils which are presently commercially available include Unipine® 60 (from Union Camp, which is believed to contain approximately 60% terpene alcohols), Unipine® S-70 and Unipine® S-70 (from Union Camp, both are believed to contain approximately 70% terpene alcohols), Unipine® S and Unipine® 80 (from Union Camp, both are believed to contain approximately 80% terpene alcohols), Unipine® 80 (from Union Camp, which is believed to contain approximately 80% terpene alcohols), Unipine® 85 (from Union Camp, which is believed to contain approximately 85% terpene alcohols), Unipine® 90 (from Union Camp, which is believed to contain approximately 90% terpene alcohols), as well as Alpha Terpineol 90 (from Union Camp, which is believed to contain approximately 100% terpene alcohols). Further effective pine oils include Glidco® Pine Oil™ 60 (available from Glidco Organics Corp., Jacksonville, Fla., believed to contain approximately 60% terpene alcohols), Glidco® Pine Oil 60 (available from Glidco Organics Corp., Jacksonville, Fla., believed to contain approximately 60% terpene alcohols); Glidco® Pine Oil 140 (available from Glidco Organics Corp., Jacksonville, Fla., believed to contain approximately 70% terpene alcohols); Glidco® Pine Oil 80 (available from Glidco Organics Corp., Jacksonville, Fla., believed to contain approximately 80% terpene alcohols) Glidco® Pine Oil 150 (available from Glidco Organics Corp., Jacksonville, Fla., believed to contain approximately 85% terpene alcohols); Glidco® Terpene SW (available from Glidco Organics Corp., Jacksonville, Fla., believed to contain approximately 75% terpene alcohols); as well as Glidco® Terpineol 350 (available from Glidco Organics Corp., Jacksonville, Fla., believed to contain approximately 100% terpene alcohols). A pine oil (only one type) is also available from Whitaker Oil Company, Spartansburg, S.C. Other products which can contain up to 100% pure alpha-terpineol, may also be used in the present invention.

The third component (C) of the present cleaning composition is 2–10%, and in one embodiment 4–8% by weight of an organic solubilizer, distinct from the pine oil. Preferred organic solubilizers include $C_1$–$C_8$ alcohols, glycols and glycol ethers represented by the formula $R^1O—[R^2O]_n—R^3$ wherein $R^1$ is a hydrogen or hydrocarbyl group of 1 to 10 carbon atoms, and in one embodiment 1 to 8, and in one embodiment 2 to 6 carbon atoms; each $R^2$ independently is an alkylene group of from 2 to 5 carbon atoms, and in one embodiment 2 to 3 carbon atoms; n is a number from 1 to 10, and in one embodiment from 2 to 5; and $R^3$ is a hydrogen or hydrocarbyl group of 1 to 10 carbon atoms, and in one embodiment from 2 to 6 carbon atoms, and mixtures of said alcohols, glycols and glycol ethers.

As used herein, the term "hydrocarbyl substituent" or "hydrocarbyl group" is used in its ordinary sense, which is well known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Suitable examples of $C_1$–$C_8$ alcohols include ethanol, isopropanol, butanol, pentanol, hexanol, heptanol and octanol. Suitable examples of glycols include ethylene and propylene glycols. The glycol ethers falling within the scope of the above formula include alkylene glycol monoalkyl ethers and alkylene glycol dialkyl ethers. Examples of useful glycol ethers include propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl (including n-butyl) ether, diethylene glycol n-butyl ether, diethylene glycol phenyl ether, propylene glycol phenol ether, and mixtures thereof. Such glycols are presently commercially available from a number of sources (such as Dow Chemical Company and Union Carbide). As used herein, the term "propylene" includes both straight chain ($—CH_2CH_2CH_2—$) and branched ($—CH_2CH(CH_3)—$) structures.

The fourth component (D) of the present pine oil cleaning composition is 0.1–5%, and in one embodiment 1–4% by weight of an alkalinity agent well known to those skilled in the art. Preferred alkalinity agents include sodium and potassium hydroxide and mixtures thereof.

The fifth component (E) of the present pine oil cleaning composition is 0.1–15%, and in one embodiment 2–10% by weight of an anionic surfactant well known to those skilled in the art. Preferred anionic surfactants include sulfate and sulfonate metal salts, said salts having a hydrocarbyl group of from 5 to 20, and in one embodiment from 8–18 carbon atoms. The metal ion in these metal salts are preferably sodium and potassium with sodium being more preferred. Such sulfate and sulfonate metal salts are available commercially from Clariant Corporation under the trademarks Genapol™ and Hostapur™. In one embodiment, the sulfate salt is a $C_{12}/C_{14}$-alkyldiglycolethersulfate sodium salt represented by the formula $$R^4O—(CH_2CH_2O)_2—SO_3^-Na^+$$

wherein $R^4$ is a $C_{12-14}$ alkyl group, and is available commercially under the name Genapol™ LRO from Clariant Corporation. In one embodiment, the sulfate salt is a $C_{12}/C_{14}$-alkyltriglycolethersulfate sodium salt represented by the formula $$R^5O—(CH_2CH_2O)_3—SO_3^-Na^+$$

wherein $R^5$ is a $C_{12}$–$C_{14}$ alkyl group, and is available commercially under the name Genapol™ ZRO from Clariant Corporation.

In one embodiment, the sulfonate salt is a mixture of (i) a $C_{14}/C_{16}$-α-olefin sulfonate sodium salt represented by the formula $R^6CH{=}CHCH_2—SO_3^-Na^+$ and (ii) the corresponding hydrolyzed product represented by the formula $R^6CH(OH)CH_2CH_2—SO_3^-Na^+$, wherein $R^8$ is a $C_{14-16}$ alkyl group, said mixture available commercially under the names Hostapur™ OS and OSB from Clariant Corporation. In an especially preferred embodiment, the sulfonate salt is a secondary alkane sulfonate sodium salt represented by the formula

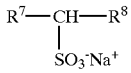

wherein $R^7$ and $R^8$ are alkyl groups, such that $R^7$ and $R^8$ together contain 12 to 16 carbon atoms, and is available commercially under the name Hostapur™ SAS from Clariant Corporation.

The sixth component (F) of the present cleaning composition is 0.01–2%, and in one embodiment 0.05 to 1% by weight of a cationic surfactant comprising a quaternary ammonium salt represented by the by the formula

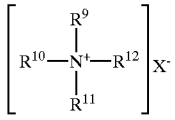

wherein $R^9$ and $R^{10}$ are independently a hydrogen or a $C_{1-3}$ alkyl group, such as a methyl, ethyl, isopropyl and n-propyl group; $R^{11}$ is a $C_{8-18}$ alkyl group, and in one embodiment a $C_{8-10}$ alkyl group, and in one embodiment a $C_{10-14}$ alkyl group, and in one embodiment a $C_{14-18}$ alkyl group; and $R^{12}$ is a $C_{1-3}$ alkyl group, such as a methyl, ethyl, isopropyl and n-propyl, or an ethoxylate group represented by the formula $—CH_2CH_2O)_yH$, wherein y is a number from 1 to 3; and $X^-$ is a halide ion, such as fluoride, chloride, bromide, and iodide, or a methosulfate. In one especially preferred embodiment, both $R^9$ and $R^{10}$ are methyl, $R^{11}$ is a $C_{12}$–$C_{14}$ alkyl group, $R^{12}$ is $CH_2CH_2OH$, and $X^-$ is chloride; i.e., the quaternary ammonium salt is represented by the formula

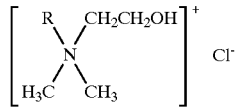

wherein R is a $C_{12}$–$C_{14}$ alkyl group. This material is available commercially under the trademark "Praepagen™ HY" from Clariant Corporation.

The seventh component (G) of the present cleaning composition is 0.1 to 10%, and in one embodiment, 2–8% by weight of a nonionic surfactant comprising at least one alcohol alkoxylate.

In one embodiment, the alcohol alkoxylate is represented by the formula $R^{13}O—[CH_2CH(R^{14})O]_m—H$ wherein $R^{13}$ is a hydrocarbyl group of 1 to 20 carbon atoms, and in one embodiment 10 to 20 carbon atoms; each $R^{14}$ independently is hydrogen or methyl, and m is a number from 3 to 15.

In one embodiment, the alcohol alkoxylate is one where $R^{13}$ is a $C_{11}$ alkyl group (i.e., undecyl), $R^{14}$ is hydrogen, and m is 3, 5, 7, 8, or 11. These alcohol alkoxylates which are ethoxylates (i.e., $R^{14}$ is hydrogen) are commercially available under the name "Genapol® UD" from Clariant Corporation. In an especially preferred embodiment, the alcohol ethoxylate is one where $R^{13}$ is undecyl, $R^{14}$ is hydrogen, and m is 7 and is available under the name Genapol® UD 070 and 079. In this nomenclature, the first two digits of the three digit number that follow the name indicate the number of moles of ethylene oxide on the alcohol. The last digit represents the activity of the product. Thus both Genapol® UD 070 and UD 079 contain 7 ethylene oxide repeat units, and while the former is 100% active, the latter is 90% active.

In one embodiment, the ethoxylate is one where $R^{13}$ is a linear $C_{12}/C_{14}/C_{16}$ mixed alkyl group. These ethoxylates are based on $C_{12}/C_{14}/C_{16}$ mixed linear alcohols derived from coconut/palm kernel oil, and are available commercially under the name "Genapol® 26-L" from Clariant Corporation. At low ethylene oxide content, the number following the "L" (for linear), is the number of ethylene oxide (EO) repeat units in the molecule. For water soluble ethoxylates in the same series, the aqueous cloud point is used in the nomenclature. Thus "Genapol® 26-L" indicates the hydrophoble is a $C_{12}/C_{14}/C_{16}$ mixed oleochemical alcohol with 3 moles of ethylene oxide; Genapol® 26-L-60 is the same hydrophobe (i.e., $C_{12}/C_{14}/C_{16}$ mixed linear alcohol) with a cloud point of 60° C.

In one embodiment, the ethoxylate is one where $R^{13}$ is nonylphenyl. These ethoxylates are available under the name "Hostapal®" available from Clariant Corporation. These nonylphenol based ethoxylates contain 4, 6, 9, 10, 13, and 15 ethylene oxide repeat units. The same nomenclature as described hereinabove for the Genapol® UD series of ethoxylates is also used for the Hostapale ethoxylates. Thus, the name "Hostapal® N 090" that the ethoxylate is 100% active nonylphenol and contains 9 ethylene oxide repeat units.

The compositions of the present invention are clear and phase stable at room temperature and higher (e.g., 52° C.) for prolonged periods (e.g., after one month). The compositions exhibit exceptional blooming properties upon dilution with water.

The cleaning compositions of the present invention may be used directly as a "concentrate", or used after dilution with water. The term "concentrate" refers to the pre-consumer dilution and composition of the cleaning composition which essentially is the form of the product that may be used by the consumer or other end user, who then would normally dilute the same with water to form a cleaning composition. It is to be understood however that nothing in the invention would bar its use as cleaning composition without any further dilution. Dilutions may be prepared by diluting the concentrate with water in the range of 1:0.1 to 1:1000, preferably in the range of 1:1 to 1:500, and more preferably in the range of 1:10 to 1:150. The actual dilution selected is in part determined by the degree and amount of dirt and grime to be removed from a surface(s), the amount of mechanical force imparted to remove the same, as well as the observed efficacy of a particular dilution. Generally better results and faster removal is to be expected at lower relative dilutions of the concentrate in the water.

Optional Ingredients

Compositions of the present invention may optionally include one or more conventional additives known to be useful in pine oil type cleaning compositions including germicidal agents, viscosity modification agents, fragrances (natural or synthetically produced), foaming agents, water softening agent, additional co-surfactants including anionic, cationic, nonionic, amphoteric and zwitterionic surface active agents, especially those useful in providing further detersive effects, additional organic solvents for physical stability purposes, sequestering agents (chelating agents), such as phosphonate chelating agents (e.g., the Dequest™ line of phosphonates), amino carboxylate chelating agents (e.g., EDTA and metal salts thereof), carboxylate chelating agents, polyfunctionally-substituted aromatic chelating agents and mixtures thereof, and coloring agents. Chelating agents such as the above are disclosed in U.S. Pat. Nos. 6,048,836 and 4,414,128.

Such optional constituents should be selected so as to have little or no detrimental effect upon the blooming behavior provided by the inventive compositions, and generally the total weight of such further conventional additives may comprise up to 20%, and in one embodiment up to 10% by weight of the pine oil cleaning composition. Such optional ingredients are well known to those of ordinary skill in the art and are disclosed in U.S. Pat. No. 5,591,708.

Method for Cleaning a Hard Surface

The present invention also provides a method for cleaning a hard surface comprising contacting the hard surface in need of cleaning with the foregoing pine oil composition in an a mount effective for providing cleaning treatment. Suitable hard surfaces include without limitation, painted woodwork and panels, tiled walls, wash bowls, bathtubs, linoleum or tile floors, and washable wallpaper. The method may comprise using the cleaning composition directly (neat) or first diluting the composition in a sufficient amount of water or other carrier.

EXAMPLES

The following specific examples will provide detailed illustrations of the methods of producing and utilizing compositions of the present invention. These examples are not intended, however, to limit or restrict the scope of the invention in any way and should not be construed as providing conditions, parameters or values which must be utilized exclusively in order to practice the present invention. Unless otherwise specified, all parts and percents are by weight, and all temperatures are in degrees Centigrade.

The following liquid compositions (shown below in Table 1 are prepared by mixing the ingredients in water:

TABLE 1

| | Formulation # | | | | | | |
|---|---|---|---|---|---|---|---|
| Ingredients | #1 | #2 | #3 | #4 | #5 | #6 | #7 |
| Hostapur ® SAS | 5% | 5% | 5% | 5% | 5% | 5% | 5% |
| Genapol ® UD070 | 2% | 2% | 2% | 2% | 2% | 2% | 2% |
| Praepagen ® HY | 0% | 0.05% | 0.10% | 0.15% | 0.20% | 0.40% | 0.60% |
| Pine oil[1] | 15% | 15% | 15% | 15% | 15% | 15% | 15% |
| Dipropylene glycol monomethyl ether[1] | 6% | 6% | 6% | 6% | 6% | 6% | 6% |
| Sodium hydroxide | 2.35% | 2.35% | 2.35% | 2.35% | 2.35% | 2.35% | 2.35% |
| Water | to 100% | to 100% | to 100% | to 100% | to 100% | to 100% | to 100% |

[1]obtained from Whitaker Oil Company, Spartanburg, South Carolina

Cleaning performance testing utilizing the above formulations was conducted using a using a HunterLab ColorQuest® II reflectometer (available from HunterLab, Reston, Va.). The hard surface substrate was a white linoleum tile and the soil was an iron oxide based composition comprising 51% solvent comprising kerosene and stoddard solvent, 43% iron oxide and 6% oil comprising Crisco™, mineral oil and motor oil. The soil was applied over the whole surface of the linoleum substrate and the soil coated substrate was heated in an oven at 52° C. (125° F.) for 1 hours, and then allowed to cool. Each composition was tested in 4–8 replicate runs and the results shown below are determined by reflectance measurements prior to and after cleaning using the compositions below. The results, shown below in Table 2, are reported as ΔR (Delta R) (reflectance after cleaning minus reflectance before cleaning), which is indicative of stain removal power of the cleaning composition, with the larger values being indicative of better cleaning performance.

TABLE 2

| Results from Iron Oxide based Soil System | | |
|---|---|---|
| Formulation | ΔR | Error |
| #1 | 30.284 | 1.953 |
| #2 | 29.190 | 1.211 |
| #3 | 30.320 | 0.363 |
| #4 | 30.718 | 1.229 |
| #5 | 30.165 | 4.097 |
| #6 | 27.893 | 3.123 |
| #7 | 28.025 | 2.221 |
| Pine Power ™ (Commercial cleaner) | 26.718 | 2.111 |
| Lysol ™ Disinfectant Pine Cleaner (Commercial cleaner) | 4.026 | 1.173 |
| PineSol ™ (Commercial cleaner) | 11.012 | 0.805 |

A second cleaning performance testing was also conducted using an oily soil comprising 58% hexane, 34% oil comprising Wesson™ Cannola and Wesson™ vegetable oils, and 8% carbon black. The soil is pipetted onto the center of the white linoleum tile and allowed to remain in contact for 24 hours. The testing was done in 4–8 replicates for each system, and the results determined by reflectance measurements before and after cleaning. In this testing, ΔR values reflect the residual stain on the white linoleum tile, and a lower ΔR value is indicative of better cleaning power of the cleaning composition. The results are summarized in Table 3 below.

TABLE 3

| Results from Oily Soil system | | |
|---|---|---|
| Formulation | ΔR | Error |
| #1 | 9.430 | 2.404 |
| #2 | 8.712 | 3.570 |
| #3 | 7.440 | 2.487 |
| #4 | 10.926 | 2.214 |
| #5 | 11.800 | 4.026 |
| #6 | 11.413 | 6.199 |
| #7 | 9.376 | 3.584 |
| Pine Power ™ (Commercial cleaner) | 8.965 | 1.942 |
| Lysol ™ Disinfectant Pine Cleaner (Commercial cleaner) | 17.333 | 3.328 |
| PineSol ™ (Commercial cleaner) | 40.093 | 11.573 |

The blooming properties of some of the compositions were also evaluated against commercial products and there are shown in Table 4 below.

The term "blooming" or "bloom" refers to the change of water's appearance from essentially colorless and transparent to that of a milky white, cloudy appearance upon the addition of a sufficient amount of cleaning composition. The bloom effect can be immediate and delayed. The bloom effect can be more or less stable. The formulations used two ounces of test product (cleaning composition according to formulation numbers 1 and 3 or the listed commercial products in concentrated form out of the bottle) per gallon of tap water at room temperature. Visual assessments of bloom and bloom stability as well as the speed of blooming and bloom persistence were made.

TABLE 4

| Bloom Performance | | |
|---|---|---|
| Formulation | Bloom | Bloom Stability |
| #1 | Immediate | Excellent |
| | Excellent | Homogeneous |
| #3 | Immediate | Excellent |
| | Excellent | Homogeneous |
| Pine Power ™ | Nearly immediate | Good |
| | Good | Homogeneous |
| Lysol ™ | Delayed | Poor |
| | Poor | Separated |
| PineSol ™ | Delayed | Poor |
| | Poor | Separated |

Each of the documents referred to above is incorporated herein by reference in its entirety, for all purposes. Except in the Examples, or where otherwise explicitly indicated, all numerical quantities in this description specifying amounts of materials, reaction and process conditions (such as temperature, time, pressure), and the like are to be understood to be modified by the word "about".

What is claimed is:

1. A liquid pine oil cleaning composition comprising:

A) water;

B) about 5–20% by weight of pine oil;

C) about 2–10% by weight of an organic solubilizer distinct from said pine oil;

D) about 0.1–5% by weight of an alkalinity agent;

E) about 0.1–15% by weight of an anionic surfactant;

F) about 0.01 to about 2% by weight by weight of a cationic surfactant comprising a quaternary ammonium salt represented by the formula

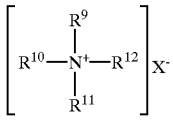

wherein $R^9$ and $R^{10}$ are independently a hydrogen or a $C_{1-3}$ alkyl group; $R^{11}$ is a $C_8$-$C_{18}$ alkyl group; and $R^{12}$ is a $C_{1-3}$ alkyl group or an ethoxylate group represented by the formula $—(CH_2CH_2O)_yH$, wherein y is a number from 1 to 3; and $X^-$ is a halide ion or a methosulfate, and G) about 0.1 to 10% by weight of a nonionic surfactant comprising an alcohol alkoxylate.

2. The cleaning composition of claim 1, wherein the pine oil (B) is a terpene that comprises at least one member selected from the group consisting of mono and sesquiterpenes.

3. The cleaning composition of claim 2, wherein the terpene is a mono- or bicyclic monoterpene selected from the group consisting of terpinenes, terpinolenes, limonenes, pinenes, and mixtures of at least two thereof.

4. The cleaning composition of claim 3, wherein the terpene is selected from the group consisting of d-limonene, dipentene, α-pinene and β-pinene.

5. The cleaning composition of claim 2 wherein the terpene is a terpene alcohol, terpene aldehyde or terpene ketone.

6. The cleaning composition of claim 1, wherein the organic solubilizer (C) is at least one member selected from the group consisting of $C_{1-8}$ alcohols, glycols and glycol ethers, said glycols and glycol ethers being represented by the formula $R^1O—[R^2O]_n—R^3$ wherein $R^1$ is a hydrogen or hydrocarbyl group of 1 to 10 carbon atoms; each $R^2$ independently is an alkylene group of about 2 to about 6 carbon atoms; n is a number from 1 to about 10; and $R^3$ is a hydrogen or a hydrocarbyl group of 1 to about 10 carbon atoms.

7. The cleaning composition of claim 1, wherein the organic solubilizer (C) is dipropylene glycol monomethyl ether.

8. The cleaning composition of claim 1, wherein the alkalinity agent (D) is sodium or potassium hydroxide.

9. The cleaning composition of claim 1, wherein the anionic surfactant (E) comprises at least one sulfate or sulfonate metal salt, said salt having a hydrocarbyl group of about 5 to about 20 carbon atoms.

10. The cleaning composition of claim 9, wherein the metal salt is a sodium or potassium salt.

11. The cleaning composition of claim 9, wherein the sulfonate metal salt is a secondary alkane sulfonate sodium salt represented by the formula

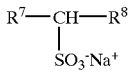

wherein $R^7$ and $R^8$ are alkyl groups such that R and R' together contain about 12 to 16 carbon atoms.

12. The cleaning composition of claim 1, wherein the nonionic surfactant (G) comprises at least one alcohol alkoxylate represented by the formula $R^{13}O—[CH_2CH(R^{14})O]_m—H$ wherein $R^{13}$ is a hydrocarbyl group of 1 to about 20 carbon atoms; each $R^{14}$ independently is hydrogen or methyl, and m is a number from about 3 to about 15.

13. The cleaning composition of claim 12, wherein $R^{13}$ is a $C_{11}$ alkyl group, $R^{14}$ is hydrogen, and m is 3, 5, 7, 8, or 11.

14. The cleaning composition of claim 1, wherein in (F), both $R^9$ and $R^{10}$ are $CH_3$; $R^{11}$ is $C_{12}$–$C_{14}$ alkyl; $R^{12}$ is $CH_2CH_2OH$; and $X^-$ is $Cl^-$.

15. The cleaning composition of claim 1, further comprising at least one optional ingredient selected from the group consisting of germicidal agents, viscosity modification agents, fragrances, foaming agents, detersive agents, co-surfactants, and coloring agents.

16. A method for cleaning a hard surface comprising contacting the hard surface in need of cleaning with the composition of claim 1.

17. A method for cleaning a hard surface comprising contacting the hard surface in need of cleaning with the composition of claim 15.

* * * * *